US005839156A

United States Patent [19]

Park et al.

[11] Patent Number: 5,839,156

[45] Date of Patent: Nov. 24, 1998

[54] REMOTE CONTROLLABLE AUTOMATIC MOVING VACUUM CLEANER

[75] Inventors: Yi Song Park; Young Pung No, both of Kwangju, Rep. of Korea

[73] Assignee: Kwangju Electronics Co., Ltd., Kwangju, Rep. of Korea

[21] Appl. No.: 769,807

[22] Filed: Dec. 18, 1996

[30] Foreign Application Priority Data

Dec. 19, 1995 [KR] Rep. of Korea ..... 1995-52127

[51] Int. Cl.[6] ..... A47L 9/00

[52] U.S. Cl. ..... 15/339; 15/340.5

[58] Field of Search ..... 15/339, 340.1

[56] References Cited

U.S. PATENT DOCUMENTS 4,306,329 12/1981 Yokoi ..... 15/339 X 4,369,543 1/1983 Chen et al. ..... 15/340.1 X 4,513,469 4/1985 Godfrey et al. ..... 15/339 X 5,109,566 5/1992 Kobayashi et al. ..... 15/340.1 X 5,709,007 1/1998 Chiang ..... 15/340.1 X

*Primary Examiner*—Chris K. Moore

*Attorney, Agent, or Firm*—Ladas & Parry

[57] ABSTRACT

A remote controllable automatic moving vacuum cleaner comprises a body having a separate intake port to intake dust, a powered moving device enabling the body to be moved forward and backward, a powered direction changing device enabling the body to be moved leftward and rightward and a wired or wireless remote control to control the devices in order to freely move the body.

20 Claims, 10 Drawing Sheets

REMOTE CONTROLLABLE AUTOMATIC MOVING VACUUM CLEANER

BACKGROUND OF INVENTION

The present invention relates to a vacuum cleaner, and in particular, to a remote controllable automatic moving vacuum cleaner which is freely movable in the forward, backward, leftward and rightward directions by remote control operation, thereby cleaning a room.

PRIOR ART

Generally, a vacuum cleaner cleans a room by utilizing a motor mounted within the cleaner to generate an intake force that collects foreign matter such as dust from a floor.

FIG. 1 is a perspective view illustrating a conventional vacuum cleaner. The vacuum cleaner includes a body 1 with a motor mounted therein, a connecting hose 3, a connecting pipe 4 and an intake port 5. The vacuum cleaner body 1 includes an inserting hole 2 on its front surface for receiving the end of the connecting hose 3 and an electric connector 8. A handle 6 is mounted between the connecting hose 3 and the connecting pipe 4 and includes a switch 7 on the upper portion thereof to be operated by users to control the drive mechanism of the vacuum cleaner. The handle 6 is hollow to permit dust to pass therethrough. The connecting pipe 4 is made of hardened materials such as plastic, etc., and may be separated into a plurality of pieces or folded with respect to one another. This facilitates easy storage or carrying of the vacuum cleaner. The intake port 5 is fixed to the front end of the connecting pipe.

The vacuum cleaner is operated by using the switch 7 to operate a motor for generating the intake force. The intake port 5 is in tight contact with a floor to intake floating matter such as dust along with air, thereby permitting dust and air to be introduced into the vacuum cleaner body 1 by passing through the connecting pipe 4 and hose 3. The dust is captured in a collecting filter (not shown) and air is discharged out of the vacuum cleaner body, thereby cleaning a room. Also, a user performs the cleaning work by moving the intake port 5 in the forward, backward, leftward and rightward directions to change the place to be cleaned. At the same time, the vacuum cleaner body 1 is moved.

However, the nature of the vacuum cleaner requires users to grasp the handle 6 to move the intake port 5 while pulling up on the connecting hose 3 if necessary. This causes much inconvenience for users because both hands are required during cleaning. If the intake port 5 cannot be moved freely, cleaning efficiency deteriorates. In particular, if users are women taking care of a child, old men or physically handicapped men, use of the vacuum cleaner is limited to a large degree.

Accordingly, in order to resolve the above problems, an object of the invention is to provide a remote controllable automatic moving vacuum cleaner having a body that is movable in the forward, backward, leftward and rightward directions by remote control to clean a room.

Another object of the invention is to provide a remote controllable automatic moving vacuum cleaner having a body that is movable in the forward, backward, leftward and rightward directions by remote control using a power source.

Another object of the invention is to provide a remote controllable automatic moving vacuum cleaner for moving wheels of a body forward, backward, leftward and rightward by control of a switch portion or a remote controller to clean a room.

SUMMARY OF INVENTION

According to the invention, a remote controllable automatic moving vacuum cleaner comprises a body including a motor, impeller and a collecting filter mounted therein, an intake port including an intake hole formed on the bottom for intaking dust, a connecting hose and a connecting pipe enabling the intake port to be connected to the vacuum cleaner body, and a handle including a switch for applying power to a motor to clean a room. The vacuum cleaner body further comprises at least one means for moving itself in the forward, backward, leftward and rightward directions.

The remote controllable automatic moving vacuum cleaner comprises at least one means for rotating at least one pair of wheels using its power source, respectively or together; means for changing the advancing direction of wheels rotatably fixed to the vacuum cleaner body; and means including a switch for remote control operation of said means.

The remote controllable automatic moving vacuum cleaner performs the cleaning work by using an intake port while moving the vacuum cleaner body.

The remote controllable automatic moving vacuum cleaner also comprises a body including means for intaking dust from the bottom thereof and means for freely moving the body to collect the dust.

BRIEF DESCRIPTION OF THE DRAWINGS

The invention now will be described in detail with reference to the accompanying drawings, in which.

DETAILED DESCRIPTION OF INVENTION

Figure 1:
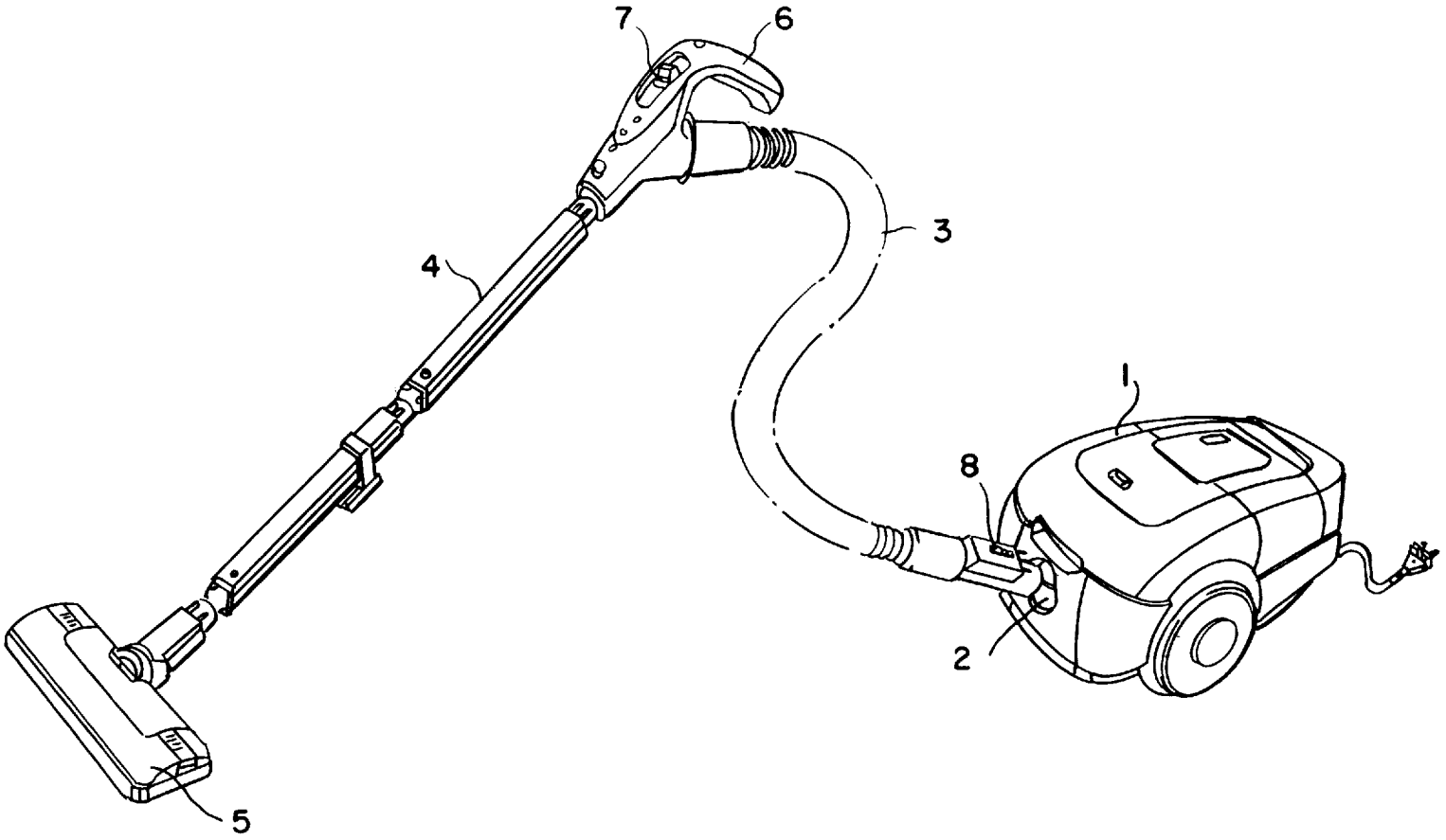
FIG. 1 PRIOR ART
FIG. 1 is a perspective view illustrating a conventional vacuum cleaner adaptable to the invention.
Figure 2:
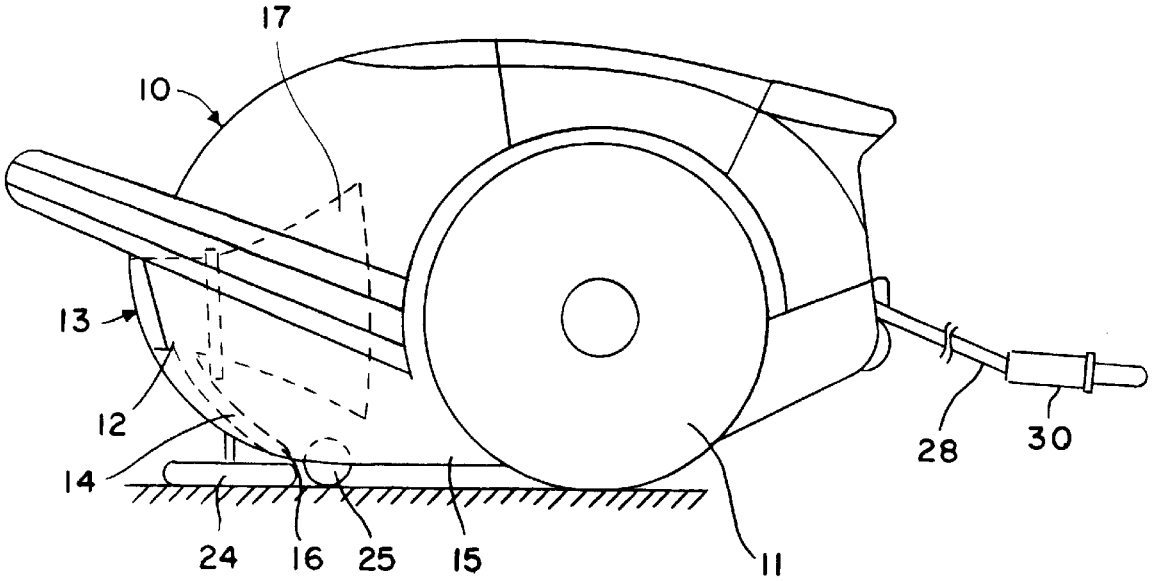
FIG. 2 is a side view illustrating a body of a remote controllable automatic moving vacuum cleaner according to the invention.
Figure 3:
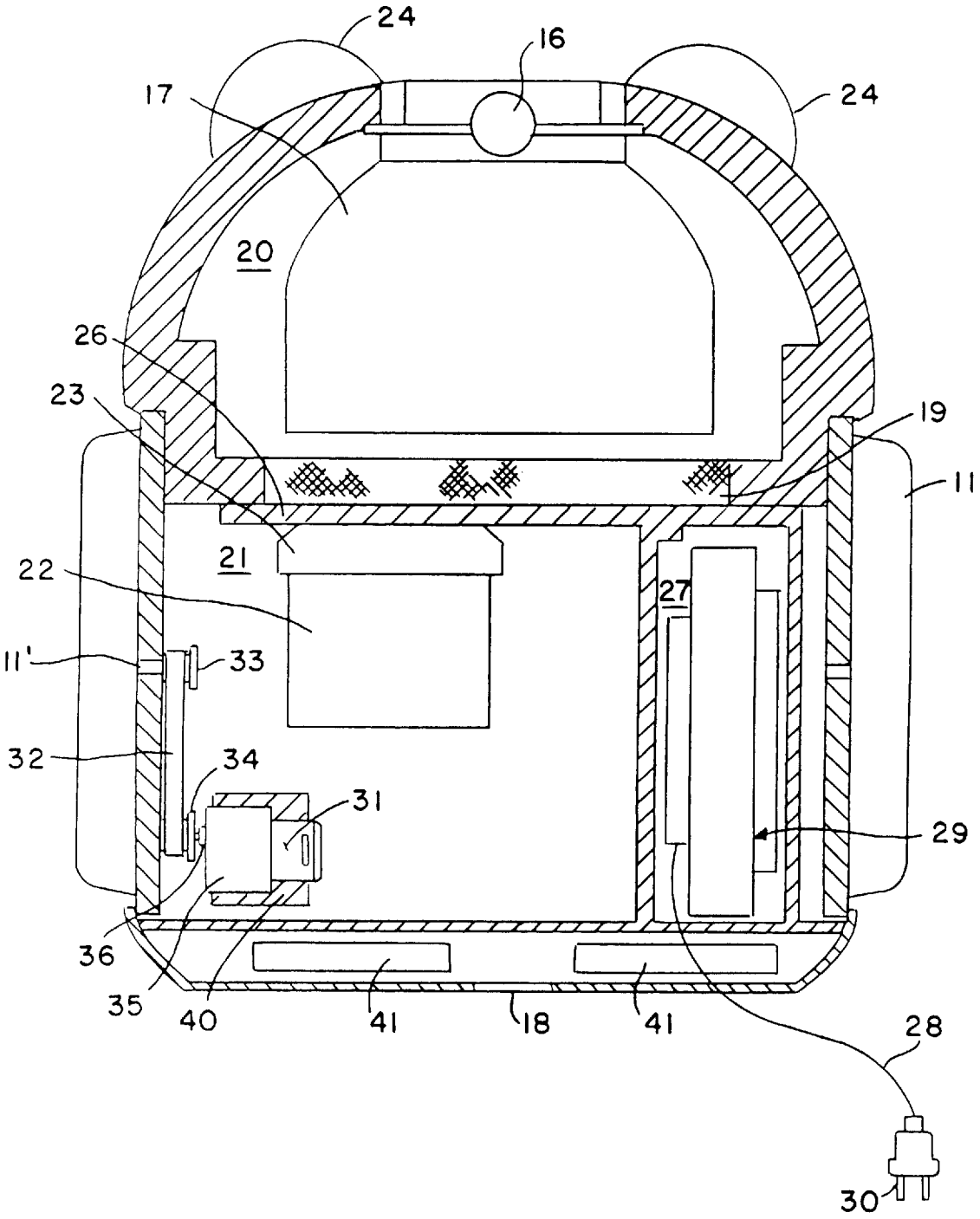
FIG. 3 is a plan cross-sectional view illustrating the vacuum cleaner body cut adjacent to the bottom thereof.

Referring to FIGS. 2 and 3, a vacuum cleaner body 10 includes large wheels 11 rotatably mounted on both sides, an inserting hole 12 formed on the bottom of the body for receiving a connecting hose (not shown), a cap 13 closing the inserting hole 12, an intake port 16 formed on the bottom surface of the body connected to a passage 14 which is curved downward adjacent to the inserting hole 12 to introduce dust into the body from the intake port 16 and an air discharging hole 18 formed on the rear surface of the body. A pair of wheels 25 are mounted adjacent to the intake port 16 for changing the advancing direction of the body 10 as described in detail below.

An intermediate filter 19 is mounted in the inner portion of the vacuum cleaner body 10 and a lower partition wall 26 is formed adjacent to the intermediate filter 19 dividing the inner portion of the body 10 into a collecting chamber 20 for collecting dust and a mechanism chamber 21 containing elements to generate the intake force. In the collecting chamber 20 a collecting filter 17 is housed near the intake passage 14 to collect dust. In the mechanism chamber 21 a motor 22 and an impeller 23 are fixed with respect to the partition wall 26 to generate the intake force. In other words, the impeller 23 is fixed to or placed on the partition wall 26, and the motor 22 is fixed to the bottom surface 15 and coupled with the rear portion of the impeller 23. The motor 22 rotates the impeller 23 to form the pressure in the collecting chamber 20, thereby intaking dust. The mechanism chamber 21 includes a receptacle 27 formed therein, in which a winding device is installed to force a power cord 28 having a plug 30 to be pulled up or loosened. A receiver 41 is mounted on the rear surface of the body 10, which constitutes part of a remote controller for use in moving the body 10. Roller brushes 24 are freely and rotatably mounted on both sides of the intake port 16, so that dust near or at the place not permitting access to the intake port 16 is introduced toward the intake port 16 and into the body 10. The roller brushes can be rotated by a motor (not shown).

Figure 6:
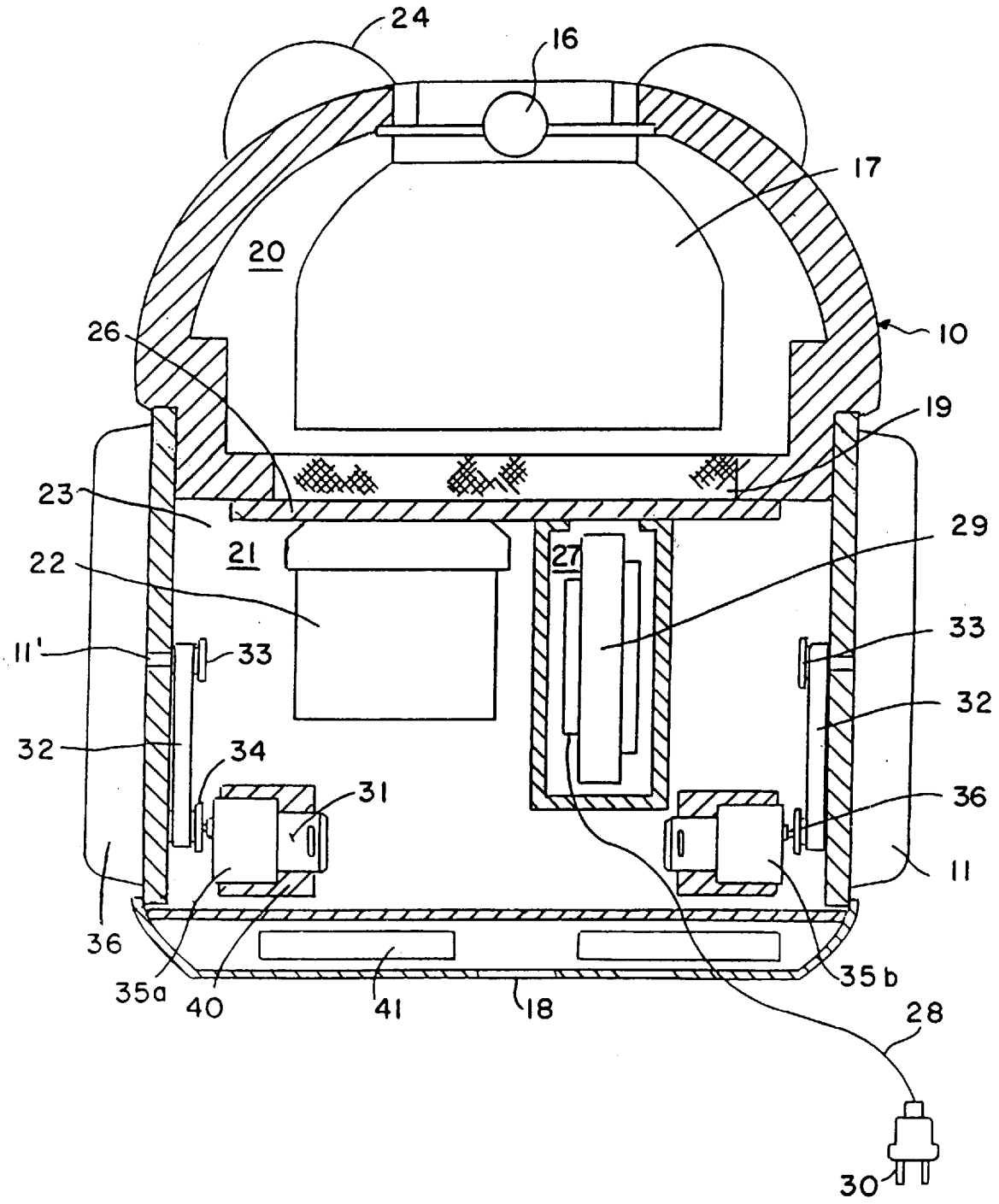
FIG. 6 is a plan cross-sectional view illustrating the mounting of the powered moving device according to one embodiment of the invention.
Figure 7:
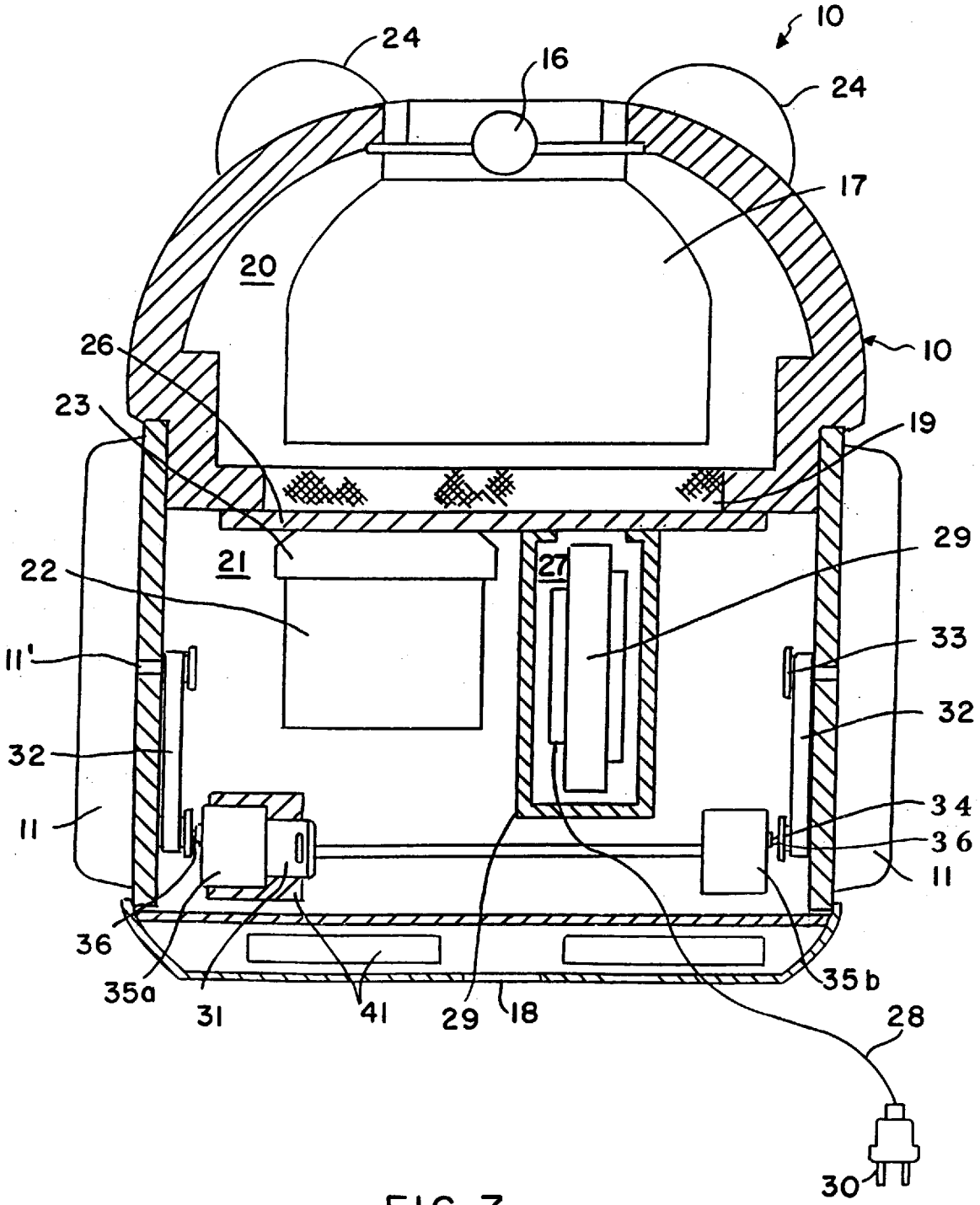
FIG. 7 is a plan cross-sectional view illustrating the mounting of the powered moving device according to another embodiment of the invention.

On the other hand, according to this embodiment, a power moving device is supposed to drive only one wheel 11, but paired wheels 11 can be simultaneously rotated like other embodiments as shown in FIGS. 6 and 7. In this respect, the embodiment comprises one powered moving device for rotating one wheel mounted in the mechanism chamber 21.

Figure 5:
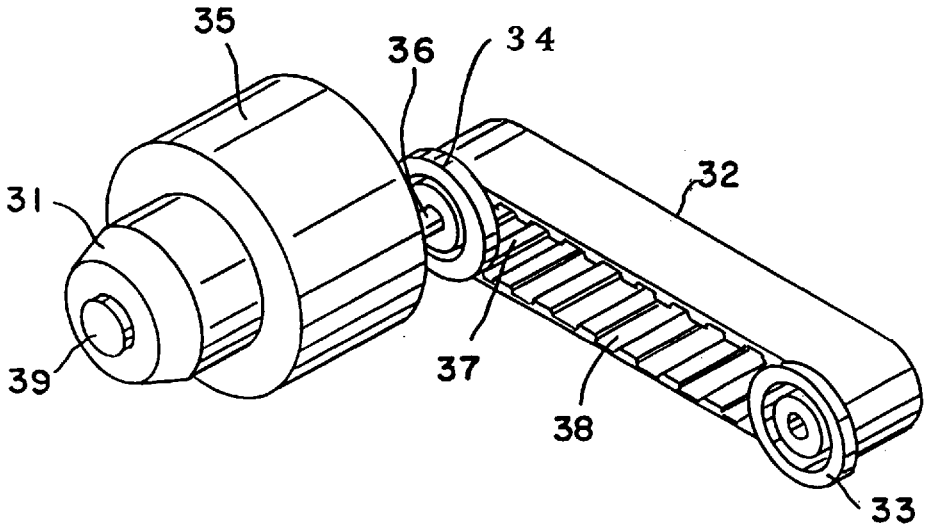
FIG. 5 is a perspective view illustrating a powered moving device according to one embodiment of the invention.

Referring to FIGS. 3 and 5, the powered moving device comprises a DC motor 31 from which a rotational force is transferred to the wheel 11. The DC motor 31 includes a decelerating gear portion 35 connected to its rotating shaft 36. Pulleys 33 and 34 are coupled to the shaft 39 of the decelerating gear portion 35 and a shaft 11' of the wheel 11. Around the outer periphery of the pulleys 33 and 34 teeth 37 are formed; and around the inner periphery of a belt 32 continuous grooves 38 are formed to engage with the teeth 37. Thus, the rotational force of the DC motor 31 is smoothly transferred to the wheels 11. The DC motor 31 is mounted on the bottom surface 15 by means of a fixture 40.

Another embodiment is shown in FIG. 6, in which another powered moving device is mounted to rotate another wheel 11 paired with the wheel of FIG. 3, which is omitted since the configuration is the same as that of the first embodiment. Also, another embodiment is shown in FIG. 7, in which a powered moving device is configured to rotate paired wheels 11 at the same time using only one DC motor 31. The DC motor 31 includes the rotating shaft 39 extended from both sides thereof, to the ends of which decelerating gear portions 35*a* and 35*b* are respectively mounted. The shafts 36 of the decelerating gear portions 35*a* and 35*b* are extended to the side surface of the vacuum cleaner body 10. The ends of the shafts 36 and the wheel shaft 11' include pulleys 33 and 34 rotatably coupled to them. Belts 32 are provided on pulleys 33 and 34 and cooperate with each other. Thus, the rotational force of the DC motor 31 is smoothly transferred to the wheels 11.

Figure 4:
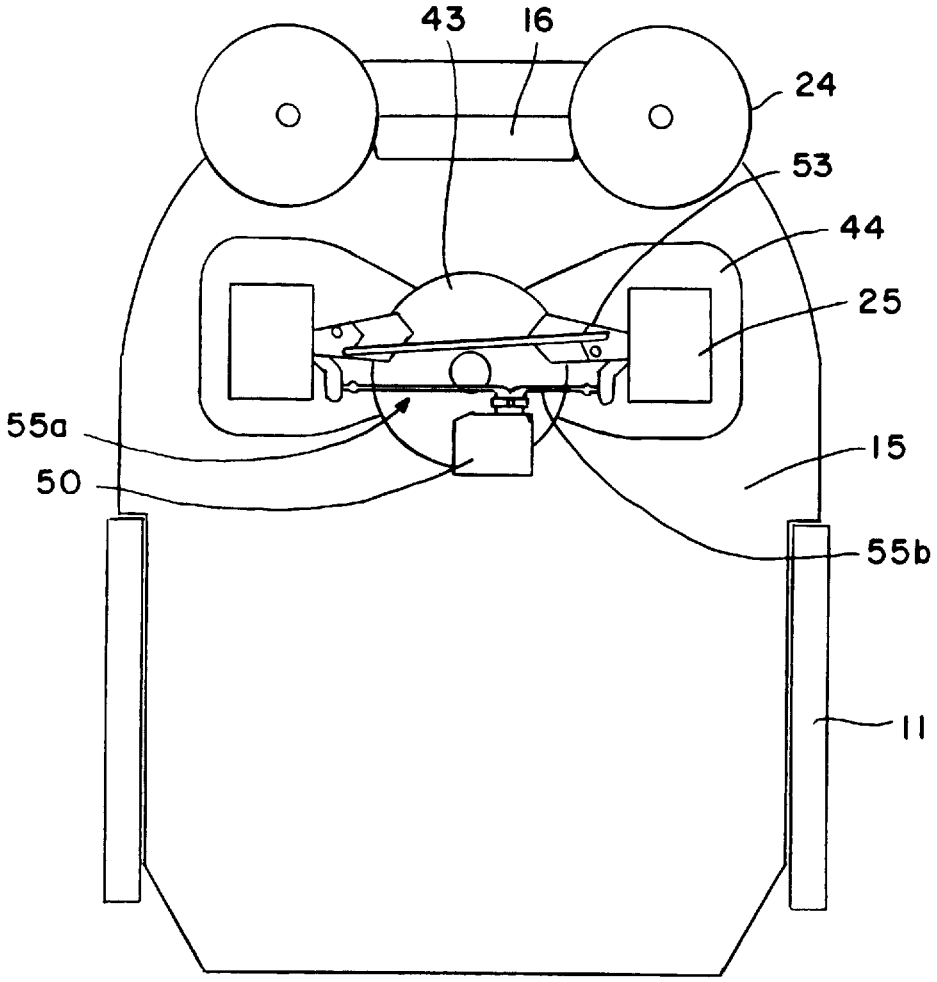
FIG. 4 is a bottom view illustrating roller brushes and a powered direction changing device according to the invention.
Figure 8:
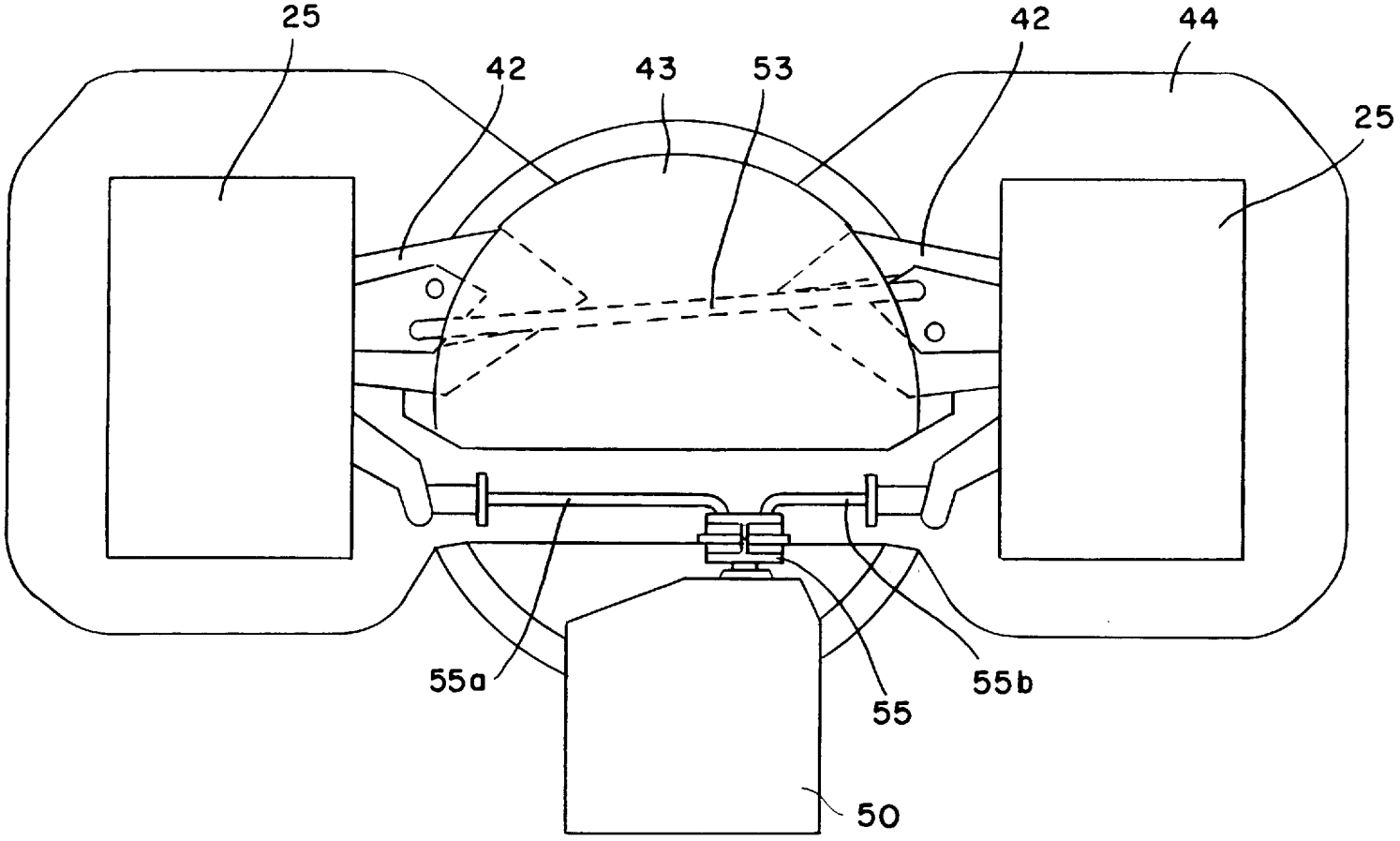
FIG. 8 is a plan cross-sectional view illustrating the powered direction changing device according to the invention.
Figure 9:
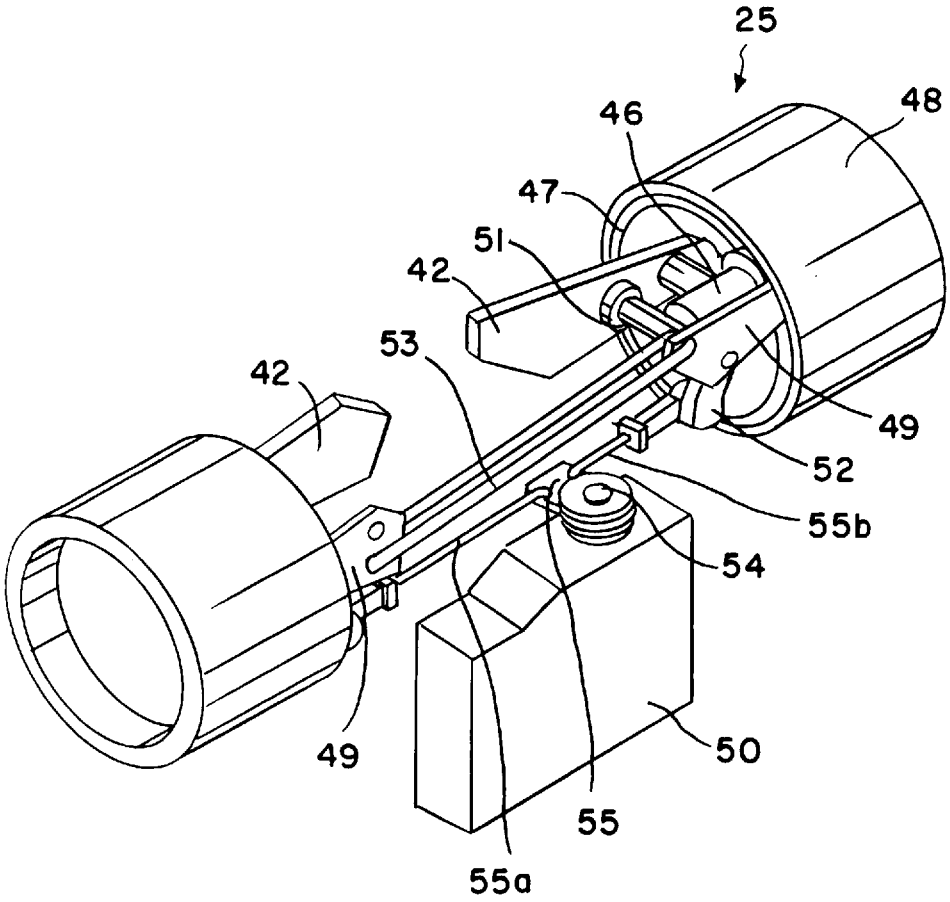
FIG. 9 is a perspective view illustrating the powered direction changing device according to the invention; and, FIG. 10 is a plan view illustrating a wireless controller according to one embodiment of the invention.
Figure 10:
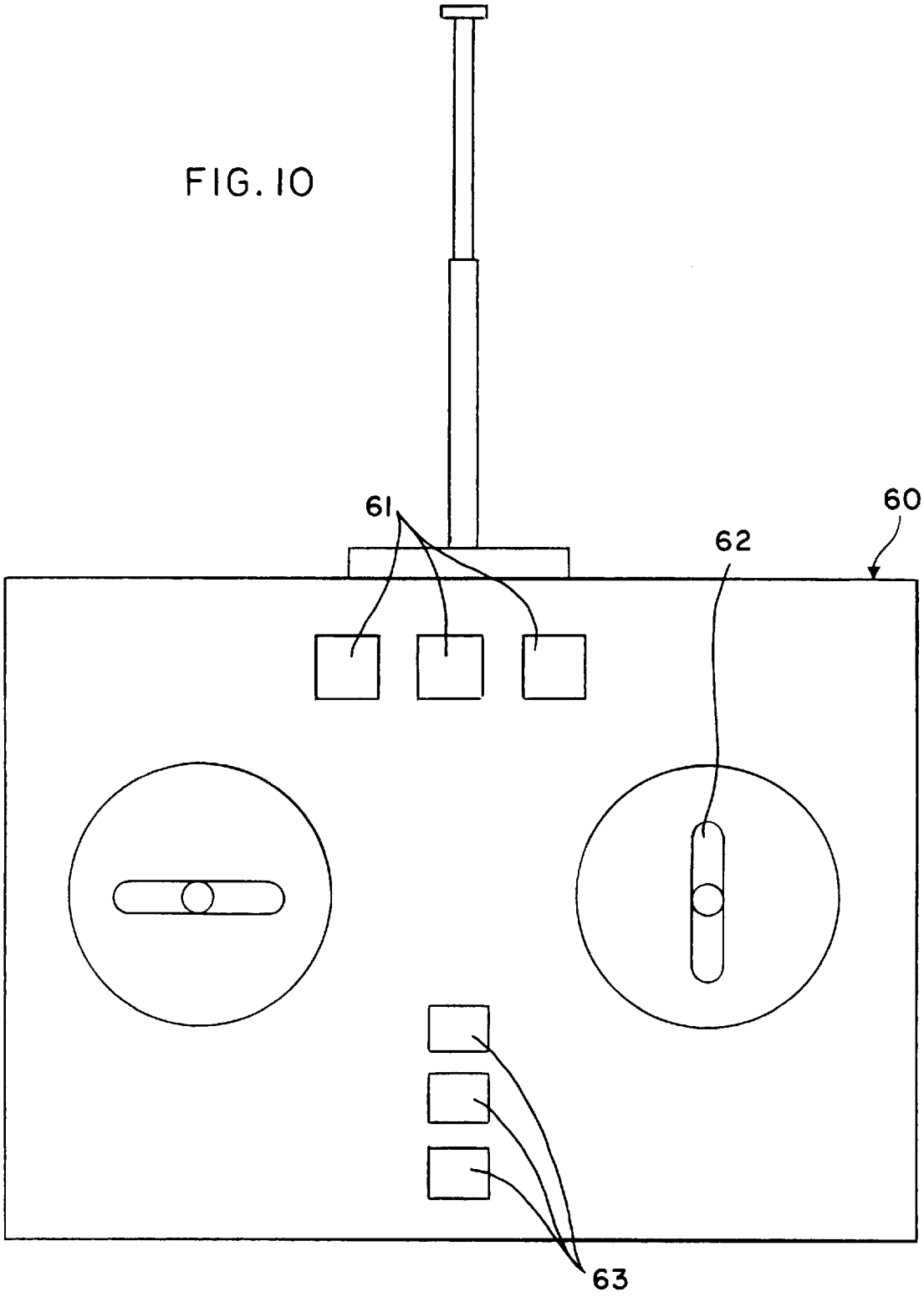

Referring to FIGS. 4, 8 and 9, a powered direction changing device is mounted on the bottom surface 15 of the collecting chamber 20. A wheel fixing portion 43, which has a circular form, is mounted on and projects slightly from the center of the bottom surface 15 to receive first ends of supporting brackets 42 for supporting the power direction changing device and wheels 25. The bottom surface 15 includes an installment groove 44, which is a groove that facilitates mounting, formed thereon for receiving the wheels 25 and elements for changing the advancing direction of the wheels 25, wherein the wheels 25 contact the ground and are received in the installment groove 44.

The powered direction changing device includes a motor 50 whose rotational force is transferred to the wheels 25.

The wheel 25 includes inner and outer periphery portions 47 and 48, in which the inner periphery portion 47 is not rotated, but the outer periphery portion 48 is freely rotated in an idle state with respect to the inner periphery portion 47. A shaft 46 is provided on the inner periphery portion 47. Brackets 42 and 49 are fixed in eccentric positions on the wheels 25 against each other with respect to the shaft 46 on the inner periphery portion 47, the other ends of which are supported with respect to each other by means of a supporting rod 51. Bracket 49 also includes a supporting piece 52 and a supporting member 53. The supporting member 53 connects both brackets 49 to each other to maintain a constant distance between wheels 25 as well as to rotate them together. The supporting pieces 52 are respectively coupled to links 55*a* and 55*b*, each end of which is fixed to a rotating piece 55 that rotates with a shaft 54 of a motor 50. The motor 50 is mounted on the wheel fixing portion 43. The brackets 42 are mounted onto the wheel fixing portion 43 and the wheels 25 are seated in the installment groove 44 thereby mounting the powered direction changing device on the bottom surface 15.

Accordingly, it is noted that the powered moving and direction changing devices enable the vacuum cleaner body to be moved in the forward, backward, leftward and rightward directions by controlling the driving of the motors. To this end, the invention can be adapted for a remote controller using an ultraviolet ray, wireless or wire transmitter along with the receiver 41 which is well known in this field (such as a control apparatus to control the motors of the powered moving and direction changing devices, solely or together).

Herein, the invention adapts a wireless controller 60 to perform the free movement of the vacuum cleaner body. The wireless controller 60 includes input elements to enable a user to input commands for the forward, backward, leftward and rightward movement of the body. For example, a plurality of inputting keys 61 are set for moving the body 10 forward and backward by rotating the DC motor 31 forward and reversely. Inputting keys 62 are set for changing the advancing direction of the body 10 by rotating the motor 50 forward and reversely. Inputting keys 63 are set for driving the motor 22 in any one of weak, intermediate and strong modes to force the body to perform the cleaning work.

Thus, the wireless controller 60 transfers control signals according to the selection of the inputting keys to the receiver 41. The receiver 41 controls the motors that force the vacuum cleaner to perform the cleaning work. Herein, the configurations of the receiver 41 and wireless adjuster 60 are claimed to have any right and can be easily realized, the explanation of which is omitted.

As described above, the invention controls the operation of the intake force-generating motor 22, the forward and backward moving motor 31 and the direction changing motor 50 when cleaning a room. In other words, the intake force-generating motor 22 rotates the impeller 28 based on the control signal to generate the intake force for intaking dust from the intake port 16. The dust is collected in the collecting filter 17 of the dust collecting chamber 20, and then air is discharged out of the body 10. The forward and backward moving motor 31 responds to the control signal to transfer its rotational force via pulleys and belts to the wheels, thereby moving the cleaner forward and backward. The direction changing motor 50, which rotates forward or reversely in response to the control signal and forces the rotating piece 55 to pull up the links 55*a* and 55*b*, thereby changing the advancing direction of the body 10 leftward or rightward.

Accordingly, the invention comprises a system that enhances the convenience of using a vacuum cleaner. The invention enables a vacuum cleaner body to be freely moved from a remote distance, thereby improving cleaning efficiency. Also, the invention makes it very convenient to clean a room.

What I claimed is:

1. A remote controllable automatic moving vacuum cleaner comprising:

a vacuum cleaner body having an intake port;

a means for intaking dust into the vacuum cleaner body through the intake port;

a means for propelling the vacuum cleaner body across a floor;

a wheel rotatably attached to the vacuum cleaner body for contacting the floor and enabling the vacuum cleaner body to be propelled across the floor, wherein the vacuum cleaner body moves forward or backward relative to the floor when the wheel rotates forward or backward relative to the body;

a powered steering mechanism for moving the wheel leftward or rightward relative to the vacuum cleaner body to steer the vacuum cleaner body leftward or rightward relative to the floor when the vacuum cleaner body is propelled across the floor; and a means for controlling the powered steering mechanism at a remote distance.

2. A remote controllable automatic moving vacuum cleaner as claimed in claim 1 wherein the means for propelling the vacuum cleaner body across a floor is a powered means controllable at a remote distance.

3. A remote controllable automatic moving vacuum cleaner according to claim 1 wherein the means for controlling the powered steering mechanism at a remote distance is a wireless controller.

4. A remote controllable automatic moving vacuum cleaner according to claim 1 wherein the vacuum cleaner body comprises at least one roller brush rotatably mounted on the vacuum cleaner body, wherein the brush contacts the floor when the vacuum cleaner body is propelled across the floor.

5. A remote controllable automatic moving vacuum cleaner comprising:

a vacuum cleaner body having a bottom;

a collecting chamber and a vacuuming motor provided in the body;

a pair of rear wheels mounted on both sides of the body;

propelling means provided in the body to propel the rear wheels, the propelling means including a propelling motor, rotating shafts extending from both ends of the propelling motor, respectively, reduction gear assemblies connected to the rotating shafts, pulleys coupled to the rear wheels and the reduction gear assemblies, respectively, and belts wound on the pulleys for each rear wheel;

a pair of front wheels positioned in openings which are formed on the bottom of the body;

direction changing means provided in the body to steer the front wheels, the direction changing means including a wheel fixing portion provided on the bottom of the body, a direction changing motor mounted on the wheel fixing portion, a rotating piece connected to the direction changing motor, links coupled to both sides of the rotating piece, respectively, supporting pieces coupled to the end of each link, shafts connected to the respective front wheels, brackets connecting each shaft to each supporting piece, and a supporting member, both ends of which are fixed to the brackets to unitedly move the front wheels; and means for controlling the propelling means and direction changing means at a remote distance.

6. The remote controllable automatic moving vacuum cleaner according to claim 5 wherein the means for controlling the propelling means and direction changing means at a remote distance is a wireless controller.

7. The remote controllable automatic moving vacuum cleaner according to claim 5 wherein the vacuum cleaner body comprises at least one roller brush rotatably mounted on the bottom of the body.

8. A remote controllable automatic moving vacuum cleaner comprising:

a vacuum cleaner body having an intake port for intaking dust into the vacuum cleaner body;

a propelling motor connected to the vacuum cleaner body for propelling the vacuum cleaner body across a floor;

a wheel rotatably attached to the vacuum cleaner body for contacting the floor and enabling the vacuum cleaner body to be propelled across the floor, wherein the vacuum cleaner body moves forward or backward relative to the floor when the wheel rotates forward or backward relative to the body;

a powered steering mechanism connected to the wheel for moving the wheel leftward or rightward relative to the vacuum cleaner body to steer the vacuum cleaner body leftward or rightward relative to the floor when the vacuum cleaner body is propelled across the floor;. and a remote controller for controlling the powered steering mechanism at a remote distance in order to move the wheel leftward or rightward relative to the vacuum cleaner body.

9. A vacuum cleaner as claimed in claim 8, wherein the remote controller for controlling the powered steering mechanism at a remote distance is a wireless controller.

10. A vacuum cleaner as claimed in claim 9, wherein the propelling motor is controllable at a remote distance by means of the wireless controller.

11. A vacuum cleaner as claimed in claim 8, wherein the powered steering mechanism comprises a steering motor and a rotating piece connected to the steering motor and connected to the wheel, whereby the wheel moves rightward or leftward relative to the vacuum cleaner body when the steering motor rotates the rotating piece.

12. A vacuum cleaner as claimed in claim 11, wherein the remote controller for controlling the powered steering mechanism at a remote distance is a wireless controller.

13. A vacuum cleaner as claimed in claim 12, wherein the propelling motor is controllable at a remote distance by means of the wireless controller.

14. A vacuum cleaner as claimed in claim 8, wherein the wheel comprises a first wheel rotatably attached to the vacuum cleaner body and a second wheel rotatably attached to the vacuum cleaner body; and wherein the powered steering mechanism comprises a steering motor and a rotating piece connected to the steering motor, the rotating piece being connected to the first wheel by a first link, the rotating piece being connected to the second wheel by a second link, whereby the first and second wheels both move rightward or leftward relative to the vacuum cleaner body when the steering motor rotates the rotating piece.

15. A vacuum cleaner as claimed in claim 14, wherein the remote controller for controlling the powered steering mechanism at a remote distance is a wireless controller.

16. A vacuum cleaner as claimed in claim 8, wherein the wheel comprises a first wheel rotatably attached to the vacuum cleaner body and a second wheel rotatably attached to the vacuum cleaner body; and wherein the powered steering mechanism comprises a steering motor, the steering motor being capable of rotating in a forward direction and in a backward direction, a rotating piece connected to the steering motor, the rotating piece rotating leftward or rightward when the steering motor rotates in the forward direction or in the backward direction, a first link coupled to the rotating piece and to the first wheel, a second link coupled to the rotating piece and to the second wheel, and a shaft with a first end connected to the first wheel and a second end connected to the second wheel, whereby the first and second wheels both move together leftward or rightward relative to the vacuum cleaner body when the steering motor rotates the rotating piece leftward or rightward.

17. A vacuum cleaner as claimed in claim 16, wherein the remote controller for controlling the powered steering mechanism at a remote distance is a wireless controller.

18. A vacuum cleaner as claimed in claim 8, wherein the propelling motor is controllable at a remote distance.

19. A vacuum cleaner as claimed in claim 8, wherein the wheel comprises a first wheel rotatably attached to the vacuum cleaner body and a second wheel rotatably attached to the vacuum cleaner body; and wherein the vacuum cleaner further comprises a third wheel and a fourth wheel, the third and fourth wheels being rotatably attached to the vacuum cleaner body for contacting the floor and enabling the vacuum cleaner body to be propelled across the floor, wherein the vacuum cleaner body moves forward or backward relative to the floor when the third and fourth wheels rotate forward or backward relative to the body, the third or fourth wheel being connected to the propelling motor so that rotational force of the propelling motor is transferred to the third or fourth wheel, whereby the third or fourth wheel rotates forward or backward relative to the vacuum cleaner body and propels the body forward or backward relative to the floor.

20. A vacuum cleaner as claimed in claim 8, wherein the vacuum cleaner body comprises at least one roller brush rotatably mounted on the vacuum cleaner body, wherein the brush contacts the floor when the vacuum cleaner body is propelled across the floor.

* * * * *